US012220011B2

(12) United States Patent
Miller

(10) Patent No.: US 12,220,011 B2
(45) Date of Patent: Feb. 11, 2025

(54) STABILIZED POCKETS FOR SPORTS APPAREL

(71) Applicant: Jack Mackenzie Miller, Archdale, NC (US)

(72) Inventor: Jack Mackenzie Miller, Archdale, NC (US)

( * ) Notice: Subject to any disclaimer, the term of this patent is extended or adjusted under 35 U.S.C. 154(b) by 86 days.

(21) Appl. No.: 17/967,538

(22) Filed: Oct. 17, 2022

(65) Prior Publication Data

US 2023/0047078 A1 Feb. 16, 2023

Related U.S. Application Data

(63) Continuation-in-part of application No. 17/150,539, filed on Jan. 15, 2021, now abandoned.

(60) Provisional application No. 62/962,286, filed on Jan. 17, 2020.

(51) Int. Cl.
*A41B 1/08* (2006.01)
*A41D 27/20* (2006.01)

(52) U.S. Cl.
CPC ..... *A41D 27/208* (2013.01); *A41B 1/08* (2013.01)

(58) Field of Classification Search
CPC ..... A41D 27/208; A41D 1/002; A41B 1/08
USPC ..... 2/113
See application file for complete search history.

(56) References Cited

U.S. PATENT DOCUMENTS

D691,795 S 10/2013 Do
9,271,533 B2 3/2016 Kochling
10,010,115 B2 7/2018 Carlson et al.
D841,292 S 2/2019 Vance
2011/0145980 A1* 6/2011 D'Alessandro ..... A41D 27/20 2/254
2011/0277206 A1 11/2011 Sokolowski
2011/0277219 A1 11/2011 Demus
2012/0054939 A1 3/2012 Chow
2012/0186000 A1 7/2012 Raviv
2016/0286866 A1 10/2016 Carlson et al.
2017/0245567 A1* 8/2017 Fathollahi ..... H02J 7/0044
2019/0041166 A1* 2/2019 Hexels ..... F41H 3/02
2019/0216138 A1* 7/2019 DiPierro ..... A41D 13/0012

OTHER PUBLICATIONS

Indiegogo, Red Rock Running, Bryce Running Shirt—Phone Pocket and Reflective, https://www.indiegogo.com/projects/bryce-running-shirt-phone-pocket-and-reflective#/, retrieved from the Internet Jul. 2, 2019.

Scott eVest, Amazon Fashion, retrieved from the Internet Jul. 2, 2019, https://www.amazon.com/SCOTTeVEST-Performance-Shirt-Long-Sleeve/dp/B01ETRR8U4.

* cited by examiner

*Primary Examiner* — Timothy K Trieu

(74) *Attorney, Agent, or Firm* — GrayRobinson, P.A.

(57) ABSTRACT

The present disclosure relates to exercise apparel. In one embodiment, the apparel takes the form of a shirt that includes front and back panels and first and second sleeves. A pocket is formed on the outside surface of each sleeve. Each pocket further includes a zippered opening. Each sleeve includes a spandex band extending around the arm opening and adapted to securely fit over the upper arm of the wearer. Each spandex band is in close proximity to the bottom edge of an associated pocket. The bands function in stabilizing the pocket and preventing excess movement while exercising.

7 Claims, 9 Drawing Sheets

STABILIZED POCKETS FOR SPORTS APPAREL

CROSS REFERENCE TO RELATED APPLICATIONS

This application is a continuation-in-part of, and claims priority to, co-pending application Ser. No. 17/150,539 filed Jan. 15, 2021, and entitled "Stabilized Pockets For Sports Apparel," which itself claims priority to Application Ser. No. 62/962,286 filed on Jan. 17, 2020 and entitled "Pock-It Training," the contents of which are incorporated herein for all purposes.

TECHNICAL FIELD

This disclosure relates to sports apparel. More particularly, the present disclosure relates sports apparel with multiple stabilized pockets for storing various personal items while engaging in sporting activities.

BACKGROUND OF THE INVENTION

Many exercise enthusiasts have to carry one or more items with them while they exercise. These items can include nutrition, such as gels, bars, or chews. These items may also include media players or mobile phones. Users may also wish to carry keys, a driver's license, or a personal protection device, such as pepper spray. The current option for carrying any of these items while exercising is limited. Current fitness apparel has no stable way of carrying these items while exercising. Although the use of pocketed exercise apparel is known, existing pockets do not retain items in a tight, secure, and stabilized fashion. The absence of such apparel in the marketplace requires individuals to purchase and carry yet another accessory to hold items in place.

An example of pocketed apparel is disclosed by U.S. Pat. No. 9,271,533 to Kochling. Kochling discloses a pocketed garment designed to cover the torso of the user. A pocket is positioned on the rear exterior of the shirt. The pocket includes two openings. A first is included for receiving a portable entertainment device and a second opening is included for a headphone wire. Yet another example is disclosed in U.S. Pat. Pub. 2012/0186000 to Raviv. Raviv discloses a t-shirt pocket for touch screen mobile devices. The front face of the pocket is formed from a transparent polymeric material that is adapted to communicate the touch of the user's fingers to the screen of the mobile device. Yet another exercise device is disclosed by the U.S. Design Pat. 691,795 to Do. Do discloses a waist belt design that is adapted to be worn around the waist of a user and that includes a pocket for securing a mobile device.

Although each of the above referenced disclosures achieves their own, unique individual objective, all suffer from common drawbacks. None of the disclosed apparel allows items to be secured held to the body of the wearer in a stabilized fashion. The apparel of the present disclosure fulfills these and other unmet needs in the art.

SUMMARY OF THE INVENTION

This disclosure relates to exercise apparel with stabilized pockets for securely holding various personal items, such as cellular telephones, keys, personal protection, IDs, and nutrition.

The pockets can also be used to hold medical devices and medications, for example, inhalers or insulin pumps.

The disclosed apparel has several important advantages. For example, the apparel includes two opposing, shoulder mounted pockets that are positioned adjacent to spandex bands that fit about the arms of the wearer.

Another advantage of the apparel is that it allows the weight of the items to be evenly distributed between the arms of the wearer.

Another advantage is realized by providing a waterproof pocket for electronics or medical devices.

Yet another advantage is that the apparel includes associated armbands with elastane cuffs built into the sleeves that securely grip the skin of the wearer to prevent movement of the pockets.

Various embodiments of the invention may have none, some, or all of these advantages. Other technical advantages of the present invention will be readily apparent to one skilled in the art.

BRIEF DESCRIPTION OF THE DRAWINGS

For a more complete understanding of the present disclosure and its advantages, reference is now made to the following descriptions, taken in conjunction with the accompanying drawings, in which.

Similar reference numerals refer to similar parts throughout the several views of the drawings.

| Parts List |
|---|
| 10 Shirt |
| 20 Front Panel of Shirt |
| 22 Back Panel of Shirt |
| 24 First Sleeve |
| 26 Second Sleeve |
| 28 Neck Opening |
| 32 Arm Openings in Sleeves |
| 34 Wiring Guides |
| 36 First Diameter of Arm Opening |
| 38 Forward Portion of Sleeve |
| 42 Rearward Portion of Sleeve |
| 44 Side Portion of Sleeve |
| 46 First Pocket |
| 52 Second Pocket |
| 54 Side Edges of Pocket |
| 60 Inner Face of Pocket |
| 62 Zippered Closure for Opening |
| 64 Outer Face of Pocket |
| 66 Stabilizing Sleeve |
| 68 Second Diameter of Stabilizing Sleeve |
| 70 Polyurethane Layers |
| 72 Double Stitching |
| 74 Interior of Pocket |

DETAILED DESCRIPTION OF THE DRAWINGS

The present disclosure relates to exercise apparel. In one embodiment, the apparel takes the form of a shirt that includes front and back panels and first and second sleeves. A pocket is formed on the outside surface of each sleeve. Each pocket further includes a zippered or Velcro flap for securing an opening of the pocket. The pockets are able to hold electronics, such as cellular phones, and medical devices and medication, for example, inhalers and insulin pumps.

The pockets can also be used to hold medical devices and medications, for example, inhalers or insulin pumps.

Each sleeve includes a spandex band extending about the arm opening and adapted to securely fit over the upper arm of the wearer. Each spandex band is in close proximity to the bottom edge of an associated pocket. The bands function in stabilizing the pocket and preventing excess movement of the pocket's contents while exercising. The various details of the apparel are described in greater detail hereinafter.

Figure 1:
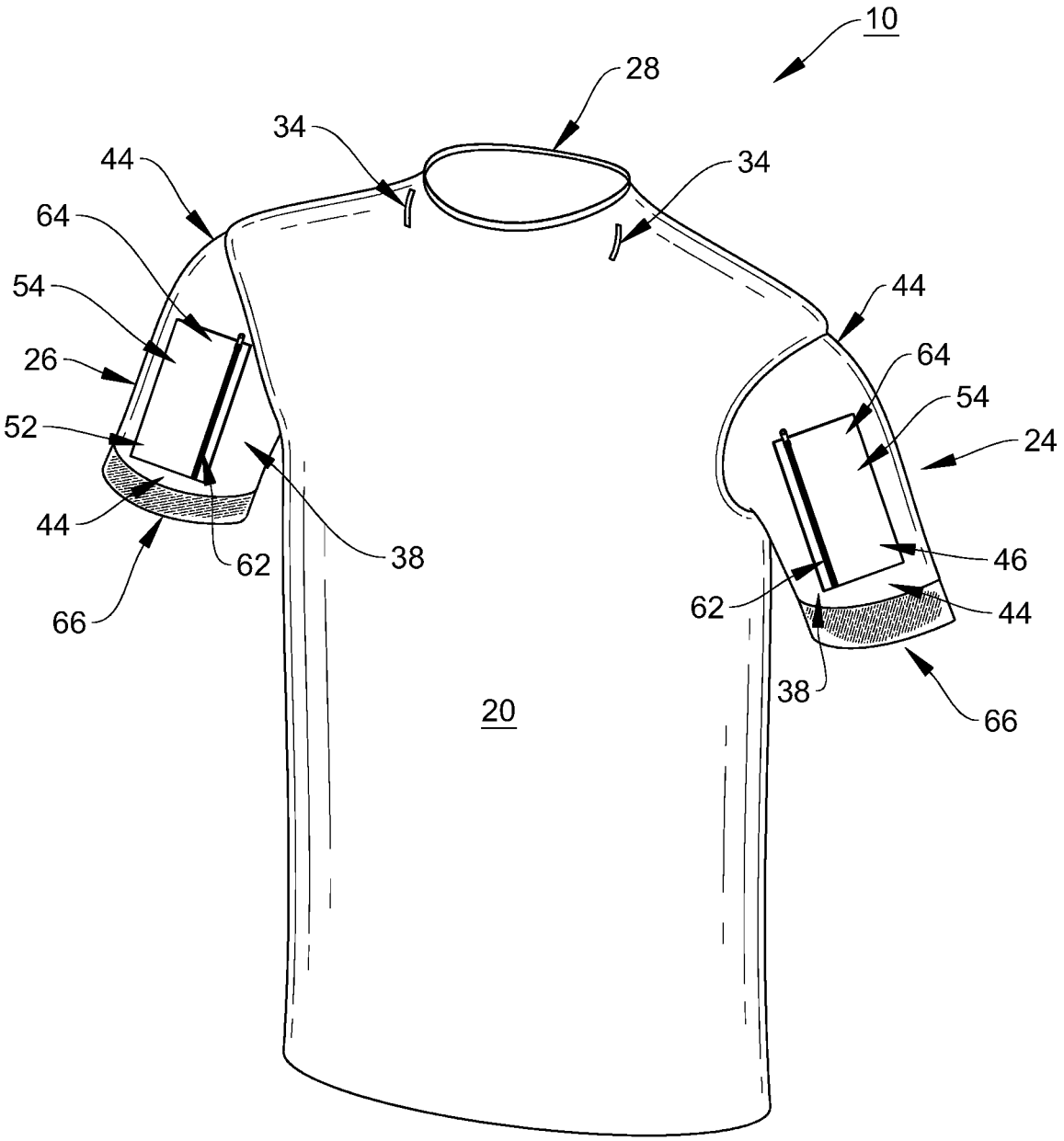
FIG. 1. is a perspective view of the apparel of the present disclosure.

A preferred embodiment of the sports apparel of the present disclosure is illustrated in FIG. 1. The particular apparel disclosed is a shirt 10. However, the principles of the present disclosure can be used in connection with other apparel, such as shorts, sweatshirts, or jackets. The depicted shirt 10 includes front and back panels (20, 22) and first and second sleeves (24, 26). The majority of shirt 10, including the panels and sleeves (20, 22, 24, 26), is formed from a breathable, moisture wicking fabric such as blends of nylon or polyester. In a preferred by non-limiting example, shirt 10 is made from a blend consisting of up to 92% polyester. Polyester/nylon blends can also be employed.

Figure 2:
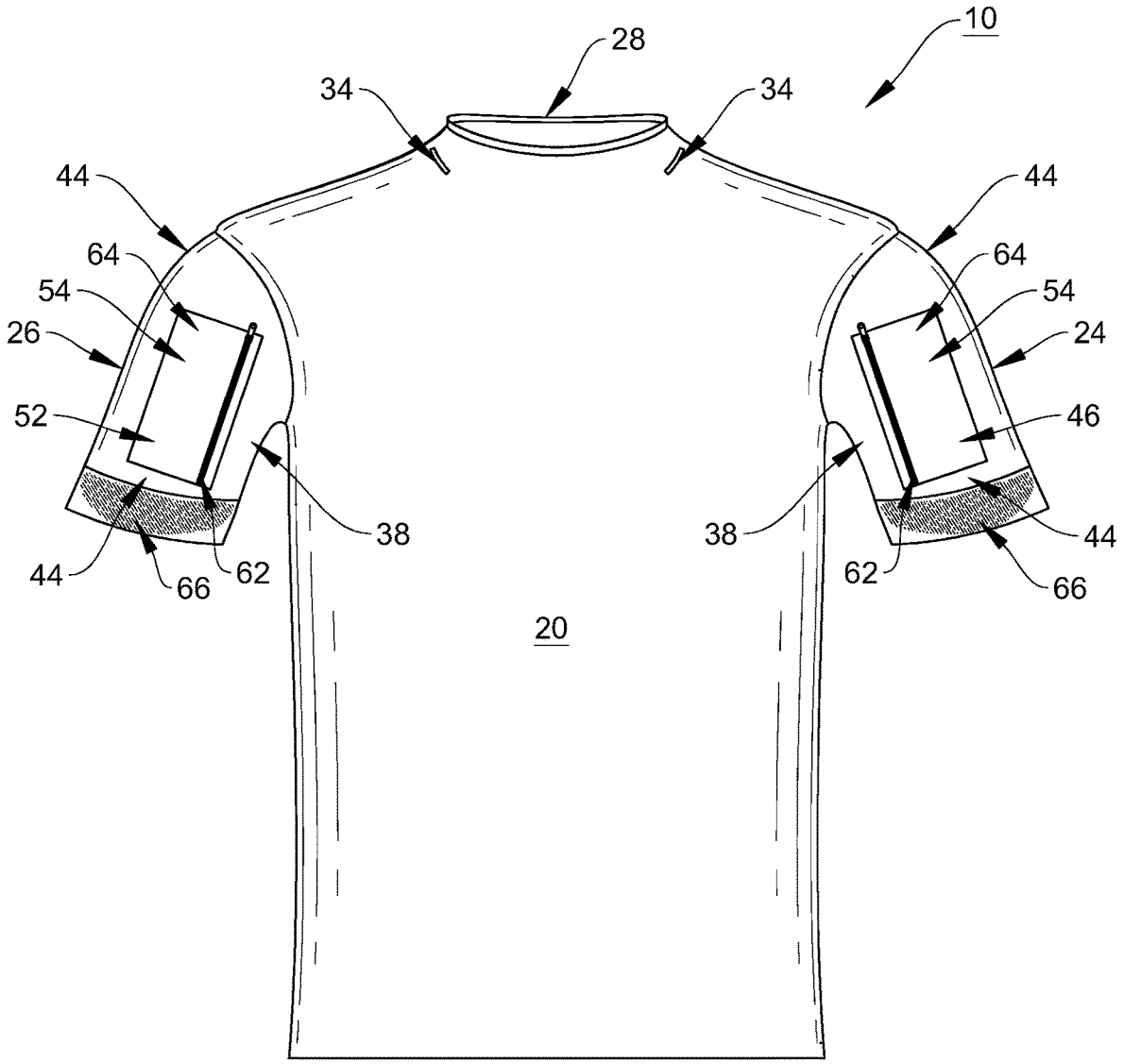
FIG. 2 is a front elevational view of the apparel of the present disclosure.
Figure 3:
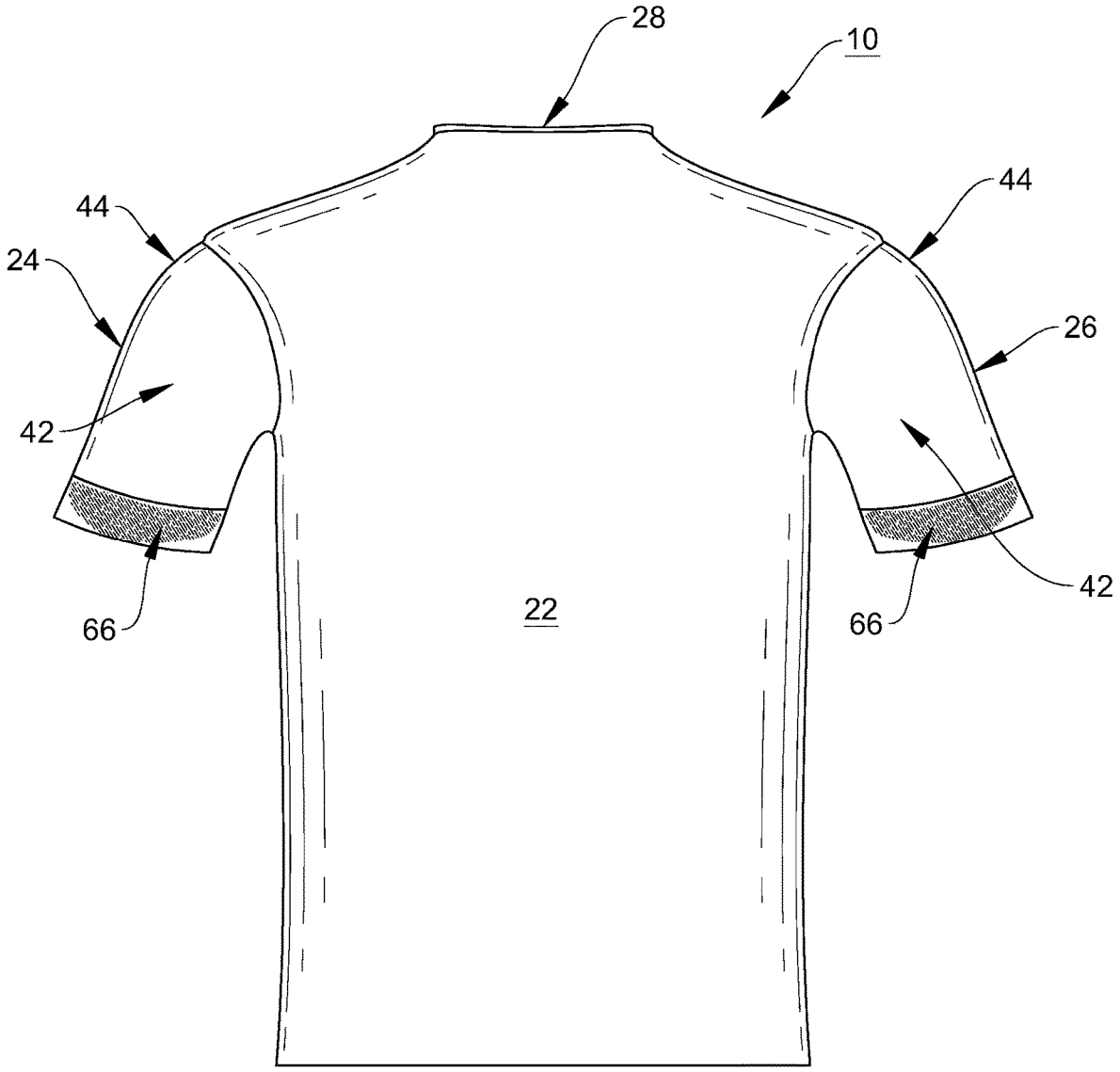
FIG. 3 is a rear elevational view of the apparel of the present disclosure.
Figure 4:
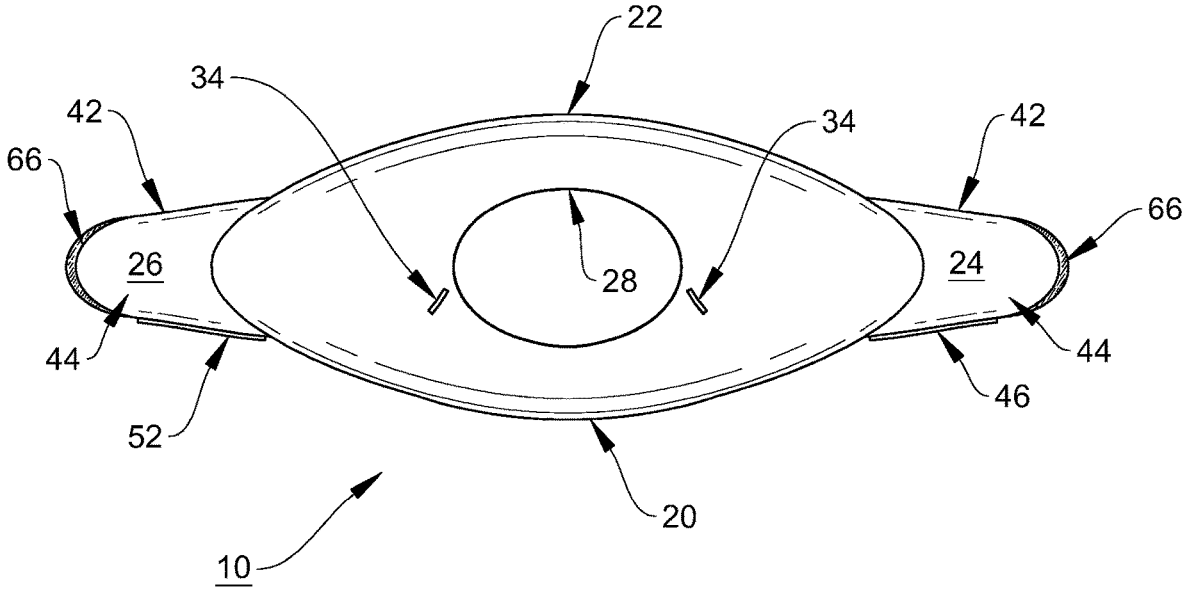
FIG. 4 is a top plan view of the apparel of the present disclosure.
Figure 5:
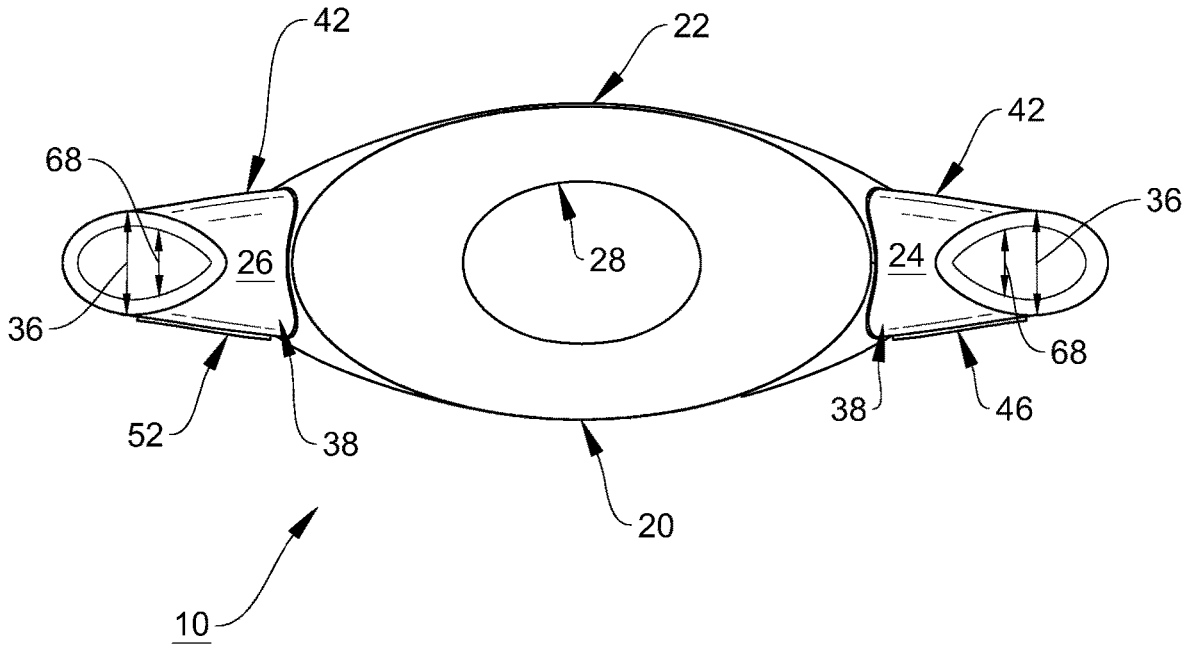
FIG. 5 is a bottom plan view of the apparel of the present disclosure.
Figure 6:
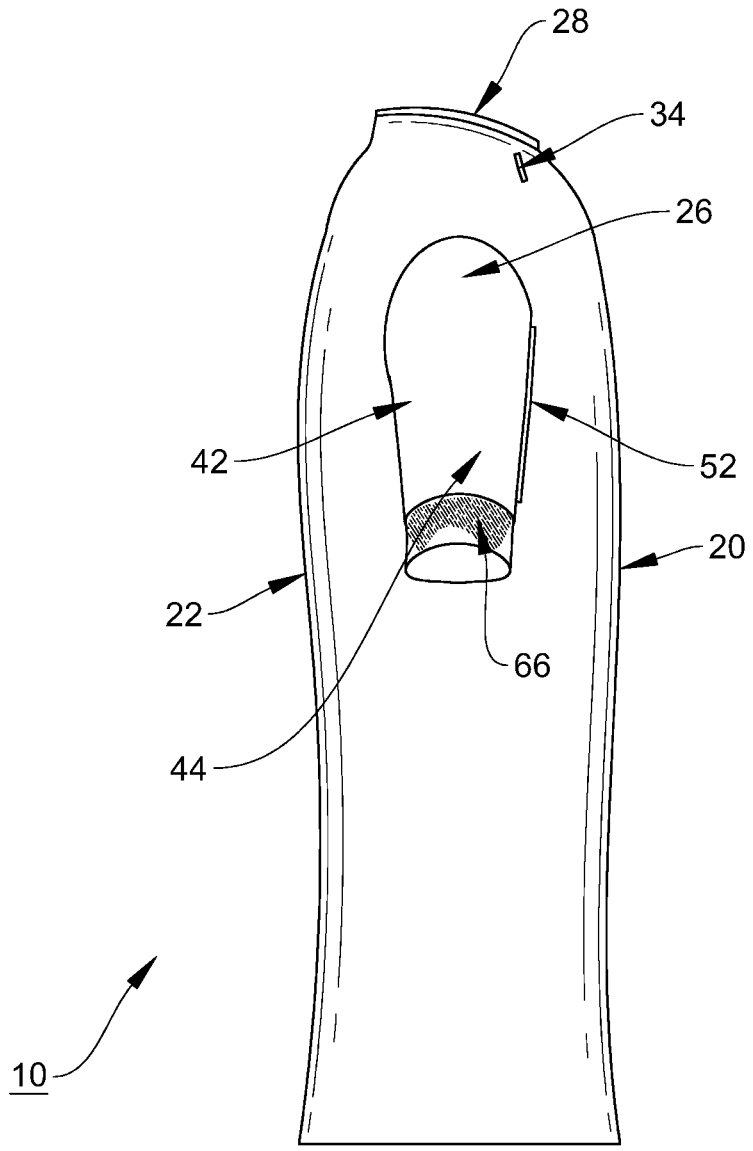
FIG. 6 is a right side view of the apparel of the present disclosure.
Figure 7:
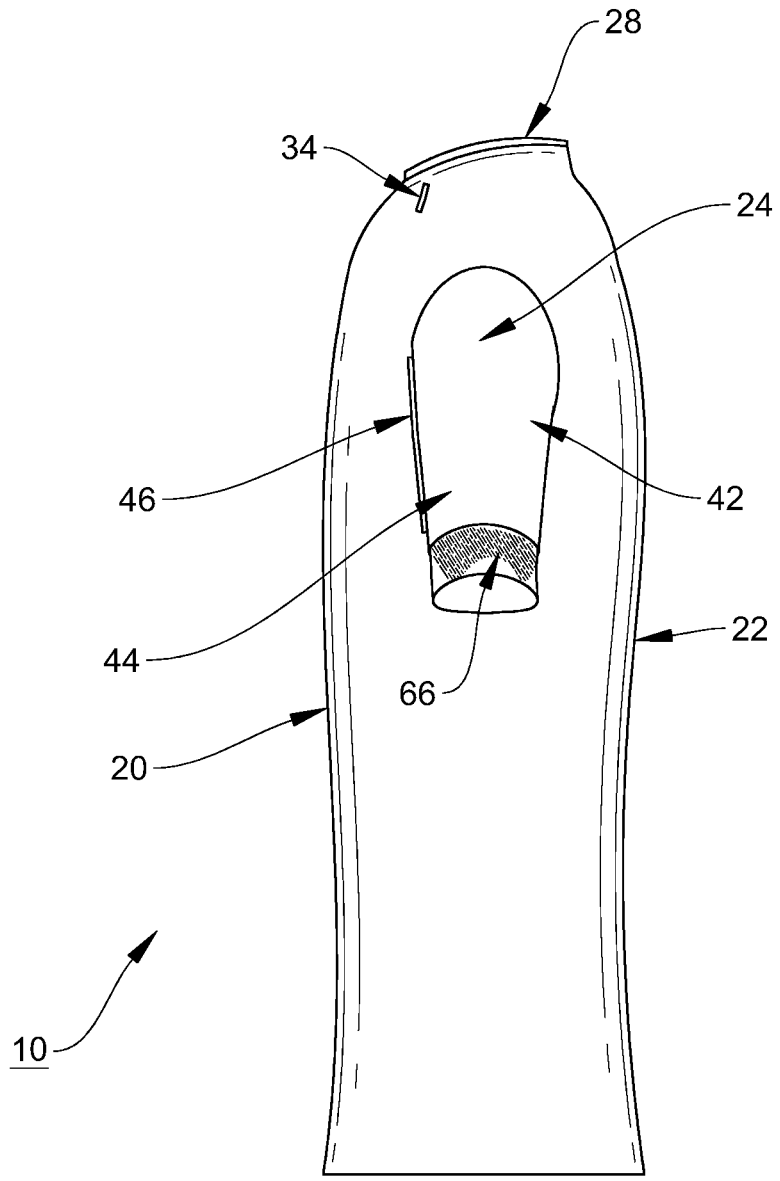
FIG. 7 is a left side view of the apparel of the present disclosure.
Figure 8:
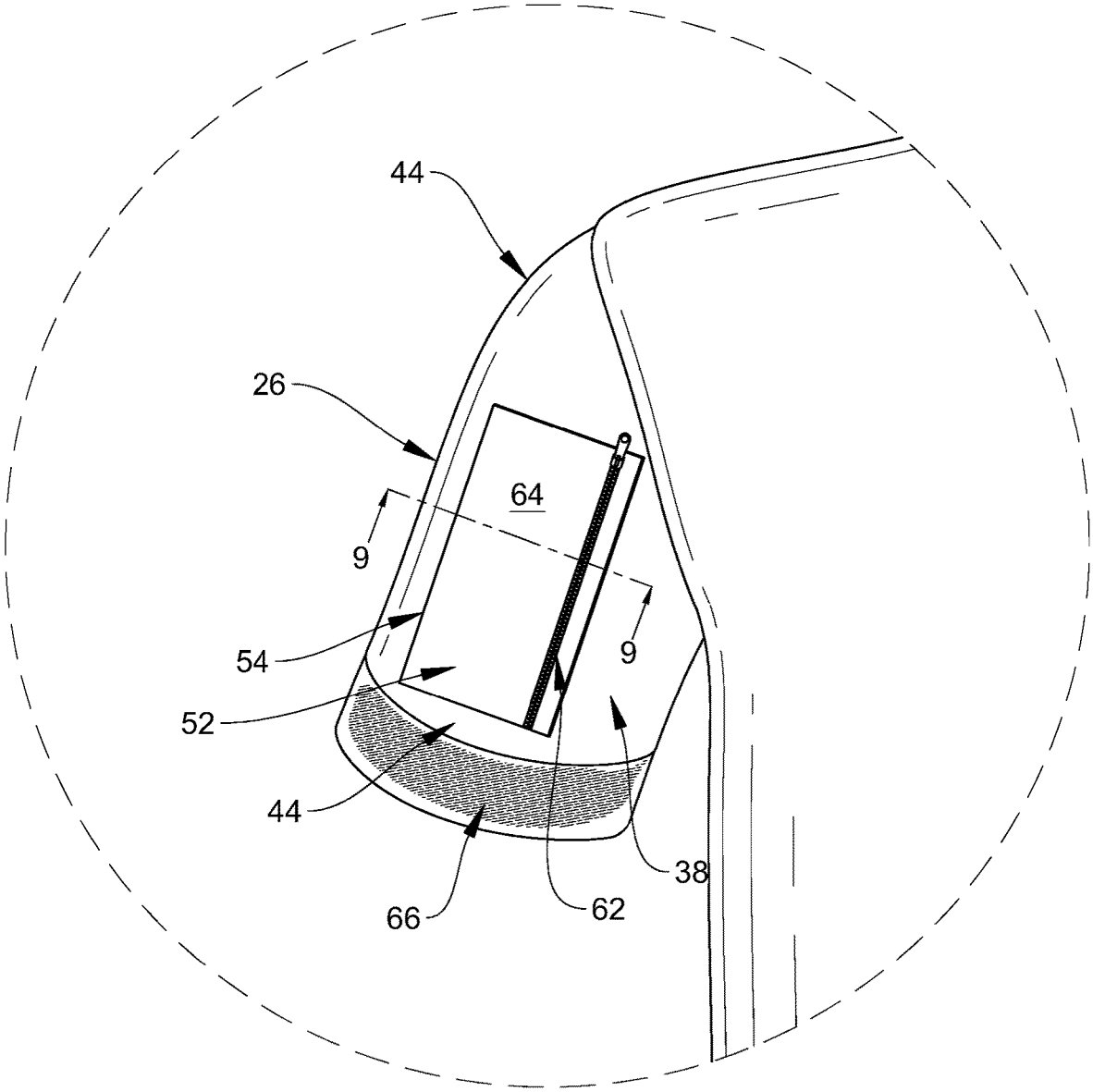
FIG. 8 is a sectional view of the sleeve of the apparel of the present disclosure.
Figure 9:
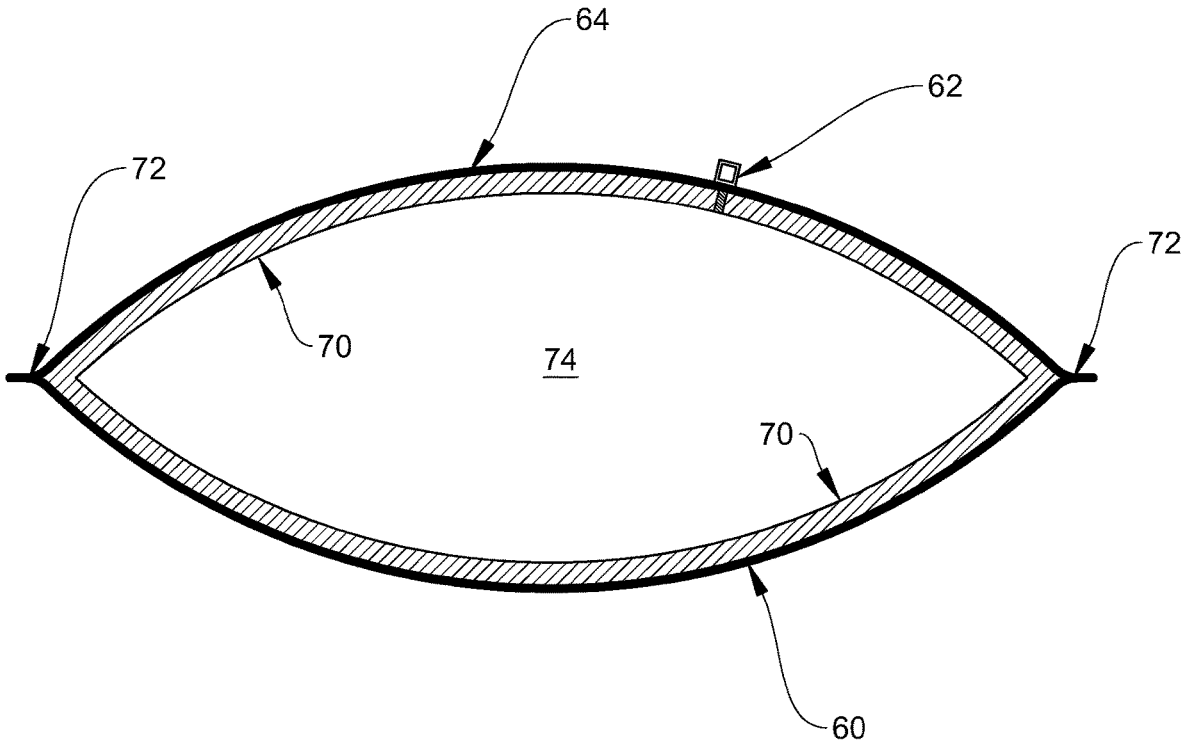
FIG. 9 is a cross-sectional view of the pocket of the apparel of the present disclosure.

With reference to FIGS. 1 and 2, the front and back panels (20, 22) define a neck opening 28. First and second sleeves (24, 26) are also included with each defining an arm opening 32. Wiring guides 34 are preferably included adjacent neck opening 28. This wiring guide 34 is a small strip of fabric that is sewn to the underlying panel and that includes a small opening for routing an audio cable. The audio cable is routed from an adjacent pocket to a location adjacent the neck opening 28. Each arm opening 32 defines a first diameter 36 at its opened end. Each sleeve (24, 26) is further defined by forward, rearward, and side extents (38, 42, and 44). Each side extent 44 is positioned over the outside shoulder of the wearer. Namely, with the wearer's arms at their sides, the side extents 44 point to the left and right of the user.

The pockets are next described. In a preferred but non-limiting embodiment, a first and second pocket (46, 52) are included upon shirt 10. These pockets (46, 52) are preferably directly opposed and opposite to one another, such that the weight of any stored items can be balanced. As illustrated, a first pocket 46 is positioned upon the side extent 44 of the first sleeve 24, and a second pocket 52 is positioned upon the side extent 44 of the second sleeve 26. Each pocket (46, 52) includes four side edges 54 that are sewn to the associated sleeve (24 or 26). Each pocket (46, 52) further includes an opening secured by a zipper 62. Velcro fasteners can be used instead of a zipper. The outer face 64 and inner face 60 of each pocket (46, 52) can be formed from a spandex material. The interior 74 of the pocket is made from a polyurethane layer 70 that is attached to both the outer face 64 and inner face 60 via double stitching 72, thereby making the pocket waterproof to prevent sweat, rain, or any other liquid damage to the stored items.

In accordance with the invention, each pocket (46, 52) is anchored via an associated stabilizing sleeve 66. Namely, a pair of stabilizing sleeves 66 are included, with each stabilizing sleeve 66 being secured immediately adjacent to the arm opening 32 of an associated sleeve (24, 26). The stabilizing sleeves 66 preferably have a second diameter 68 that is substantially smaller than the first diameter 36. In a preferred embodiment, the stabilizing sleeve 66 is approximately 20% smaller than the arm opening 32 to which it is attached. As such, the stabilizing sleeves 66 have the effect of substantially narrowing each arm opening 32. This narrowing improves the tight fit of the arm opening about the upper arm of the user. Furthermore, each stabilizing sleeve 66 is formed primarily from spandex to further tightly adhere the sleeve to an upper arm of the wearer. Again, this stabilizes any objects held in the associated pocket (46, 52). Although Spandex is disclosed for the stabilizing sleeve 66, other polyether-polyurea copolymers blends can be utilized, such as Lycra or Elastane.

Although this disclosure has been described in terms of certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure.

What is claimed is:

1. A shirt for use by a wearer while exercising, the shirt comprising in combination:

front and back panels and first and second sleeves, the panels and sleeves being constructed primarily from a breathable material consisting of approximately 92% polyester, the front and back panels defining a neck opening, the first and second sleeves each defining an arm opening having a first diameter, each sleeve further including a forward extent, a rearward extent, and a side extent therebetween, each side extent adapted to be positioned over a side of the wearer's shoulder;

a first pocket positioned upon the side extent of the first sleeve and a second pocket positioned upon the side extent of the second sleeve, each pocket including an opening, upper and lower surfaces, and three sides edges, and a lower edge, a first polyurethane layer sewn to the upper surface of each pocket along all four sides via double stitching, a second polyurethane layer sewn to the lower surface of each pocket along all four sides via double stitching, each pocket further including a zipper for selectively providing access to the opening, whereby the polyurethane layers create a water proof interior for each of the pockets; a pair of stabilizing sleeves, each stabilizing sleeve being secured to the arm opening of said sleeves and at a distance from lower edge of the pockets, each stabilizing sleeve having a second diameter that is approximately twenty percent smaller than the first diameter, each stabilizing sleeve being formed primarily from elastane and functioning to tightly adhere to an upper arm of the wearer and thereby stabilize any objects held in the associated pocket; said sleeves comprises short sleeves.

2. A garment for use by a wearer while exercising, the garment comprising in combination:

front and back panels and two opposing sleeves, each opposing sleeve having an opening of a first diameter, the panels and opposing sleeves being constructed primarily from a breathable material;

a pocket positioned upon the each opposing sleeve, each pocket including an outer face formed from a mesh material that allows the wearer to see objects within the pocket; the each pocket further including three sides edges and a bottom edge, said sides edges are sewn to the each sleeve, an opening in the outer face of the each pocket, the each pocket further including a zipper for selectively securing the opening of the each pocket;

a stabilizing sleeve being secured to the opening of the each opposing sleeve and at a distance away from the bottom edge of the pocket, the stabilizing sleeve having a second diameter that is substantially smaller than the first diameter, the each stabilizing sleeve being formed primarily from spandex and functioning to tightly adhere to the wearer and thereby stabilize any objects held in the each pocket; said sleeves comprises short sleeves.

3. The garment as described in claim 2 wherein the garment is a shirt.

4. The garment as described in claim 2 wherein the pocket includes an inner face that is formed from a double-stitched layer of polyurethane laminate, the double-stitched layer making the pocket waterproof.

5. The garment as described in claim 2 wherein the top of the stabilizing sleeve is between 0.4 and 0.6 of an inch away from the pocket.

6. The garment as described in claim 2 wherein the pocket is 4 inches wide and 7.5 inches long.

7. The garment as described in claim 2 wherein a distance from the top of the pocket to the shoulder seam is between 1.75 and 3.75 inches.

* * * * *